US008042802B2

(12) United States Patent
Shiraishi et al.

(10) Patent No.: US 8,042,802 B2
(45) Date of Patent: Oct. 25, 2011

(54) TRANSPORTING DEVICE, IMAGE READING DEVICE, METHOD AND PROGRAM STORAGE MEDIUM

(75) Inventors: Keiko Shiraishi, Kanagawa (JP); Ken Kobayashi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 12/546,354

(22) Filed: Aug. 24, 2009

(65) Prior Publication Data

US 2010/0201064 A1 Aug. 12, 2010

(30) Foreign Application Priority Data

Feb. 12, 2009 (JP) ..... 2009-030270

(51) Int. Cl.
*B65H 1/00* (2006.01)

(52) U.S. Cl. ..... 271/171

(58) Field of Classification Search ..... 271/171
See application file for complete search history.

(56) References Cited

U.S. PATENT DOCUMENTS

| | | | | |
|---|---|---|---|---|
| 4,908,673 | A * | 3/1990 | Muramatsu | 399/402 |
| 4,944,504 | A * | 7/1990 | Yamada et al. | 271/171 |
| 6,213,659 | B1 * | 4/2001 | Elgee | 400/633 |
| 6,775,514 | B2 * | 8/2004 | Korhonen | 399/389 |
| 2009/0066011 | A1 * | 3/2009 | Ohno et al. | 271/171 |
| 2010/0052246 | A1 * | 3/2010 | Sing | 271/171 |

FOREIGN PATENT DOCUMENTS

JP 3729063 B2 12/2005

* cited by examiner

*Primary Examiner* — Kaitlin Joerger
*Assistant Examiner* — Patrick Cicchino
(74) *Attorney, Agent, or Firm* — Sughrue Mion, PLLC

(57) ABSTRACT

The present invention provides a transporting device that includes: a transport unit that transports a document placed on a document tray; a detector that detects the width of the document placed on the document tray; a controller that controls the transport unit to transport the document when the width of the document detected by the detector is a predetermined definite size, and prohibits the transport unit from transporting the document when the width of the document detected by the detector is a predetermined size that is different from the definite size; and a cancellation unit that cancels the prohibition on the document transportation imposed by the controller.

13 Claims, 7 Drawing Sheets

TRANSPORTING DEVICE, IMAGE READING DEVICE, METHOD AND PROGRAM STORAGE MEDIUM

CROSS-REFERENCE TO RELATED APPLICATIONS

This application is based on and claims priority under 35 USC 119 from Japanese Patent Application No. 2009-030270 filed on Feb. 12, 2009.

BACKGROUND

1. Technical Field

The present invention relates to a transporting device, an image reading device, method and a program storage medium.

2. Related Art

In a conventional image reading device that transports document sheets of a multi-page document from a document tray in a one-by-one manner, the image reading device determines whether the first page of the document is an A4R sheet or a 8.5×11R sheet. Thereafter, the image reading device starts reading the document, and continues to read the document, with the document size of the pages following the first page being set according to the determination result above.

SUMMARY

An aspect of the invention is a transporting device that includes: a transport unit that transports a document placed on a document tray; a detector that detects the width of the document placed on the document tray; a controller that controls the transport unit to transport the document when the width of the document detected by the detector is a predetermined definite size, and prohibits the transport unit from transporting the document when the width of the document is a predetermined size that is different from the definite size; and a cancellation unit that cancels the prohibition on the document transportation imposed by the controller.

BRIEF DESCRIPTION OF THE DRAWINGS

An exemplary embodiment of the present invention will be described in detail based on the following figures wherein.

DETAILED DESCRIPTION

Figure 1:
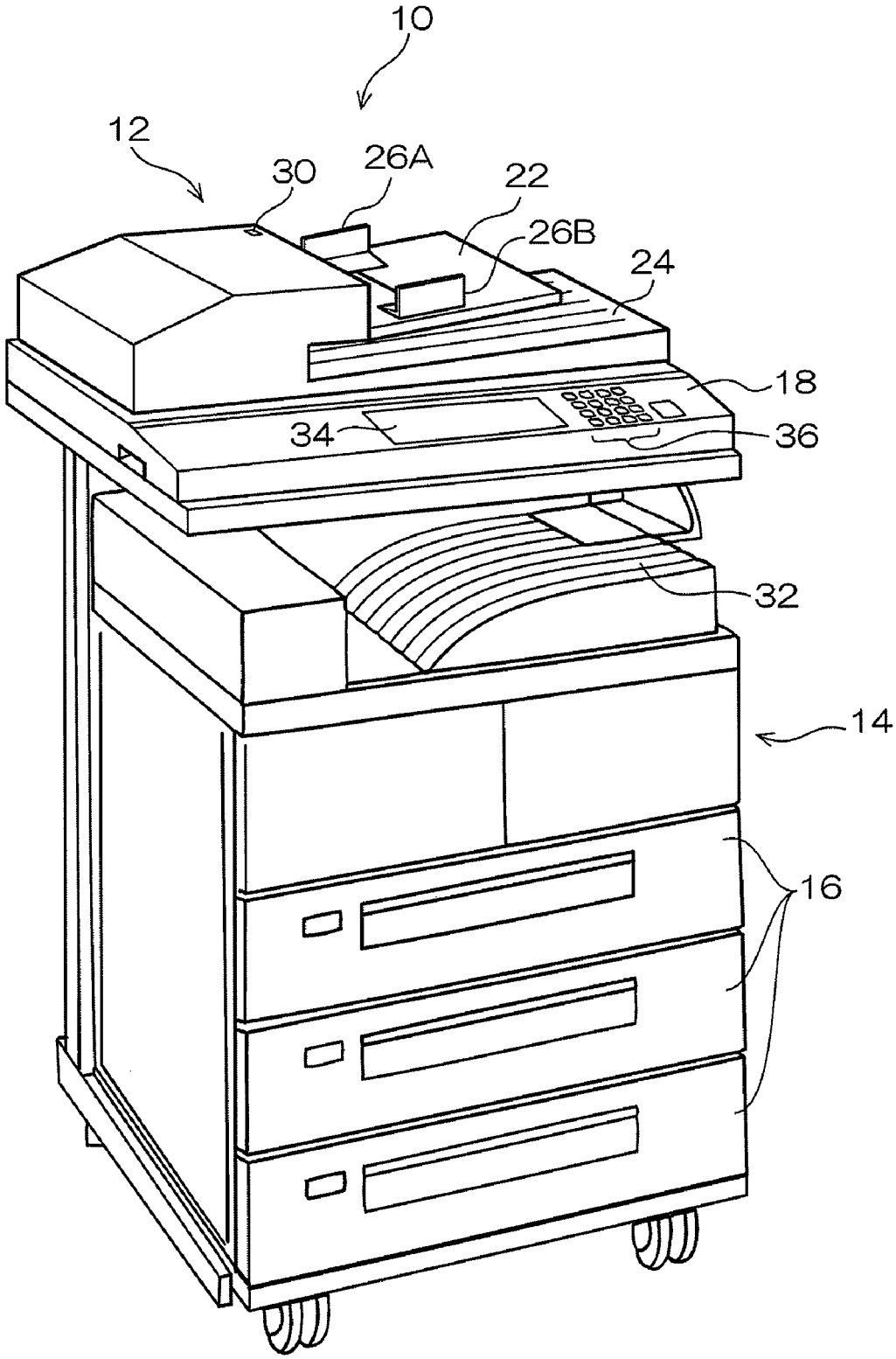
FIG. 1 is a perspective view showing an external structure of an image processing apparatus according to an exemplary embodiment of the invention.

Referring first to FIG. 1, the external structure of an image processing apparatus 10 according to an exemplary embodiment is described.

As shown in FIG. 1, the image processing apparatus 10 includes an image reading device 12, an image forming device 14, a feeding tray 16, and an operation panel 18.

The image reading device 12 takes in document sheets placed on a document tray 22 one by one, and reads the image formed on the surface of each of the document sheets. After acquiring an image data representing the read image, the image reading device 12 discharges each document sheet onto a discharge tray 24.

Figure 2:
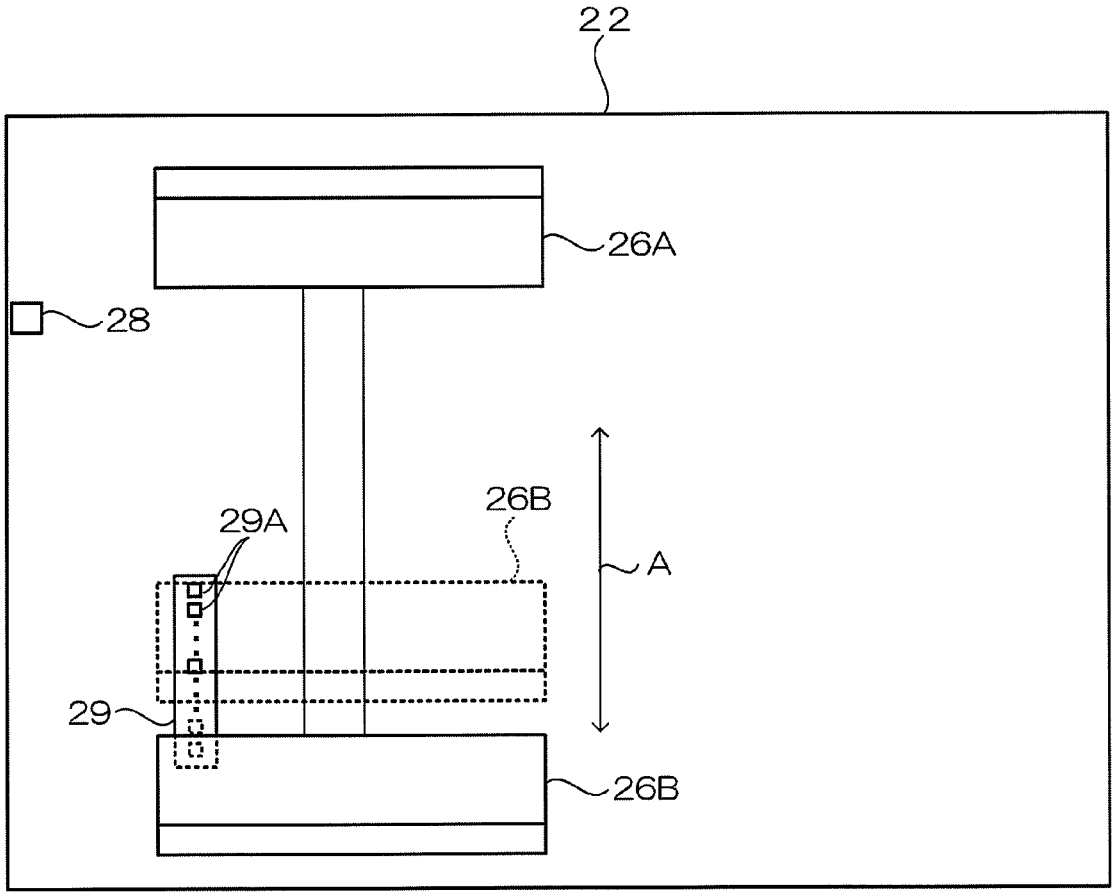
FIG. 2 is a top view of the document tray provided in the image processing apparatus according to the exemplary embodiment.

A pair of guides 26A and 26B and a document detection sensor 28 are provided on the document tray 22. As shown in FIG. 2, one of the guides 26A and 26B is movable in the width direction of the document placed on the document tray 22 (or in the direction perpendicular to the document transporting direction, or the direction indicated by the arrow A in FIG. 2). The guides 26A and 26B guide the document placed on the document tray 22 as it is being transported. The document detection sensor 28 detects the document being placed on the document tray 22.

In the image processing apparatus 10 according to this exemplary embodiment, the guide 26A is fixed, while the guide 26B is movable.

A document width detection sensor 29 for detecting the width of each document is provided under the guide 26B.

The document width detection sensor 29 according to this exemplary embodiment includes photo couplers 29A that are arranged at predetermined intervals along the document width direction. When the guide 26B moves, the photo coupler 29A located immediately below the guide 26B becomes an ON state. On the other hand, the photo couplers 29A not located immediately below the guide 26B are in an OFF state. In this manner, the document width detection sensor 29 detects the width of the document placed on the document tray 22, based on the ON or OFF states of the photo couplers 29A that change as the guide 26B moves according to the width of the document placed on the document tray 22.

In the image processing apparatus 10 according to this exemplary embodiment, a sensor that optically detects the document placed on the document tray 22 using a photo coupler is used as the document detection sensor 28. However, other sensors such as a sensor that mechanically detects a document with the use of a mechanical switch or the like may be used as the document detection sensor 28.

A document width notifying unit 30 that notifies the user that the detected document width is one of predetermined regular sizes is provided on the upper face of the image reading device 12, as shown in FIG. 1.

In the image processing apparatus 10 according to this exemplary embodiment, the predetermined regular sizes include widths of the A series (such as A3 and A4) and the B series (such as B4 and B5). Accordingly, if the document width detection sensor 29 detects a document having a letter-size width, for example, the document width notifying unit 30 does not notify the user.

In the image processing apparatus 10 according to this exemplary embodiment, a LED (Light Emitting Diode) that blinks when a document having an A-series width or a B-series width is detected is used as the document width notifying unit 30. However, a speaker that emits a sound to notify the user of the detected width of a document having an A-series width or a B-series width may also be used. Alternatively, a touch panel display 34 may also serve as the document width notifying unit 30, and display the detected width when a document having an A-series width or a B-series width is detected.

Meanwhile, the image forming device 14 takes out one of recording sheets contained in the feeding tray 16, and forms an image on the recording sheet based on the image data acquired through the image reading device 12. Thereafter, the recording sheet having the image formed thereon is discharged onto a discharge tray 32.

The operation panel 18 includes the touch panel display 34 that displays an image, and switches 36. Through the touch panel display 34 and the switches 36, a user inputs various commands, such as to cause the image reading device 12 to read a document, and to cause the image forming device 14 to form an image on the recording sheet. The touch panel display 34 further displays necessary information.

Figure 3:
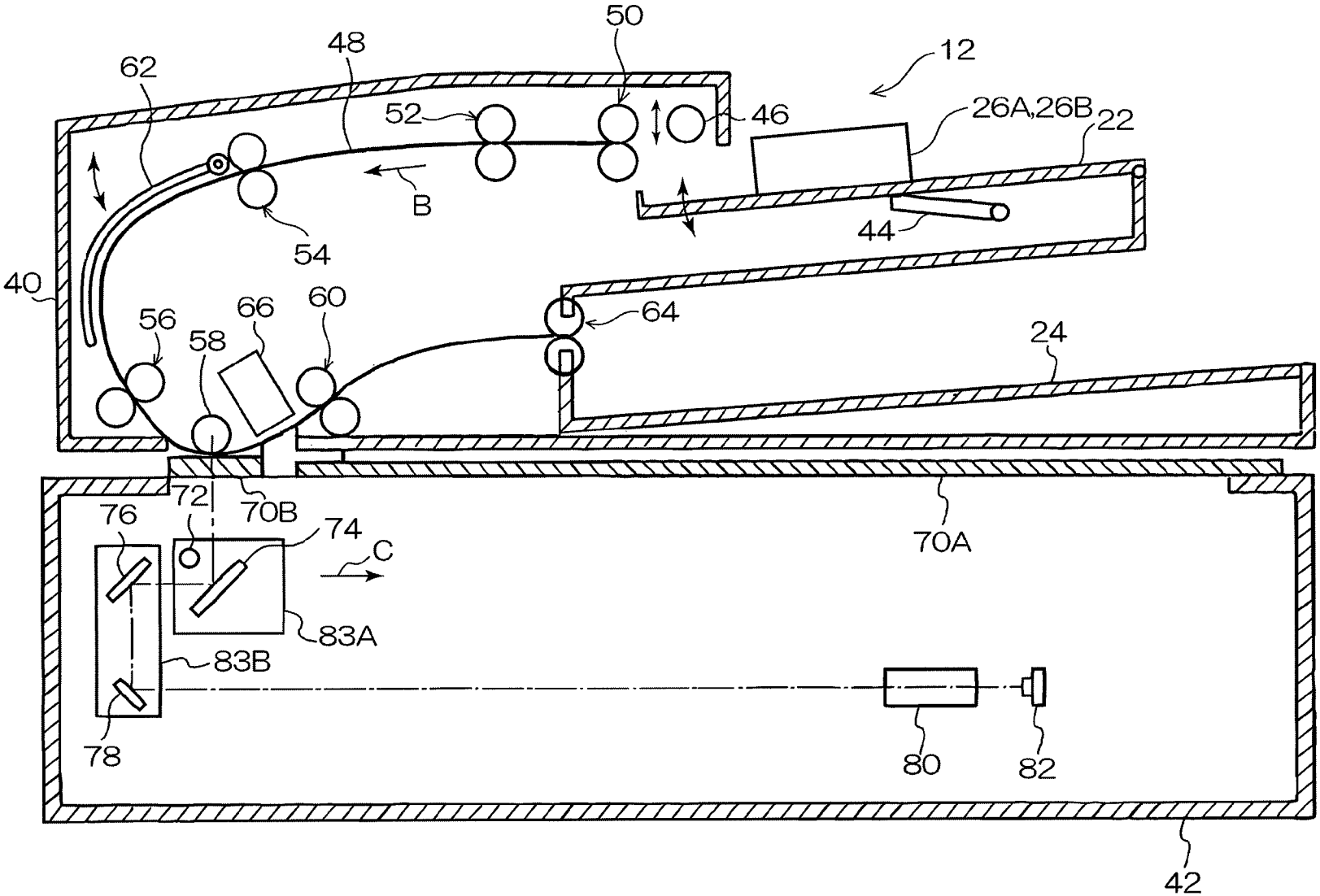
FIG. 3 is a drawing showing the structure of a scanner device according to the exemplary embodiment.

Referring now to FIG. 3, the structure of the image reading device 12 according to this exemplary embodiment is described.

The image reading device 12 includes a document transport unit 40 that transports the document placed on the document tray 22, and an image reading unit 42 that reads the image formed on the document and outputs the read image as image data.

The document transport unit 40 at the upper side includes: a tray lifter 44 that lifts up and down the document tray 22; a nudger roller 46 that touches the upper face of the uppermost sheet of the document on the document tray 22 lifted up by the tray lifter 44, and takes in the document sheets one by one; and feed rollers 50 that transport the document sheets taken in by the nudger roller 46 to a transportation path 48.

Take-away rollers 52, pre-registration rollers 54, registration rollers 56, a platen roller 58, and out rollers 60 are provided along the transportation path 48 through which each document sheet is transported. The take-away rollers 52 transport each document sheet toward the downstream side in the transporting direction (the direction indicated by the arrow B in FIG. 3). The pre-registration rollers 54 further transport the document sheet toward the downstream side so that the document sheet forms a curve. The registration rollers 56 feed the document sheet while making a registration adjustment on the document reading unit. The platen roller 58 assists the transportation of the document sheet from which an image is being read. The out rollers 60 further transport the document sheet from which an image has been read to the downstream side. A baffle 62 and discharge rollers 64 are also provided on the transportation path 48. The baffle 62 rotates about a fulcrum in accordance with the curve formed by the document sheet being transported. The discharge rollers 64 are located closer to the downstream side than the out rollers 60 in the document transporting direction, and discharge the document sheet onto the discharge tray 24.

The image reading device 12 according to this exemplary embodiment further includes a back-face image reading unit 66 that is disposed between the platen roller 58 and the out rollers 60. The back-face image reading unit 66 reads an image formed on the back face of each document sheet.

Next, the document transporting operation of the image reading device 12 according to this exemplary embodiment is described.

When not transporting a document and standing by, the nudger roller 46 is lifted up and is held at a stand-by position. When transporting a document, the nudger roller 46 is lifted down to the nip position (the document transporting position), and transports the uppermost sheet of documents placed on the document tray 22. The pre-registration rollers 54 push the top end of the document sheet against the registration rollers 56 that are inactive. In this manner, the document sheet forms a curve. Thereafter, the baffle 62 rotates about the fulcrum into an open position, so as not to hinder the document from forming a curve. The take-away rollers 52 and the pre-registration rollers 54 maintain the curve while images are being read. Through the curve formation, the timing with which the image is read is adjusted, and the skew accompanying the document transportation at the time of image reading is restricted. Accordingly, the positioning of the document is improved. When the image reading begins, the inactive registration rollers 56 are activated to start rotating and the document sheet is transported. The transported document sheet is pressed against the second platen glass 70B which is described later by the platen roller 58, so that the image formed on the document sheet is read from below.

The image reading unit 42 includes a first platen glass 70A and a second platen glass 70B, both of which are transparent. A document sheet is placed on the first platen glass 70A. The second platen glass 70B forms an optical aperture for reading the document being transported by the document transport unit 40.

A light source 72, a first reflection mirror 74, a second reflection mirror 76, and a third reflection mirror 78 are provided under the first platen glass 70A and the second platen glass 70B. The light source 72 emits illumination light onto the surface of the document. The first reflection mirror 74 receives the light reflected by the surface of the document. The second reflection mirror 76 bends the course of the reflected light received through the first reflection mirror 74 by 90 degrees. The third reflection mirror 78 further bends the course of the reflected light received through the second reflection mirror 76 by 90 degrees.

In the image reading device 12 according to this exemplary embodiment, a fluorescent lamp is used for the light source 72. However, some other type of light source may be used such as LEDs (Light Emitting Diodes) arranged in the direction perpendicular to the document transporting direction and the like.

The image reading unit 42 further includes a lens 80 and an image reading sensor 82. In the image reading unit 42, the light reflected by the third reflection mirror 78 is imaged onto the image reading sensor 82 through the lens 80. In this way, the image formed on the document is read by the image reading sensor 82.

In the image reading device 12 according to this exemplary embodiment, the back-face image reading unit 66 and the image reading sensor 82 are CCD line sensors that are structured by CCDs (Charge Coupled Devices). However, solid-state image sensors such as CMOS (Complementary Metal-Oxide Semiconductor) image sensors may be used for the back-face image reading unit 66 and the image reading sensor 82.

In the image reading device 12 according to this exemplary embodiment, the light source 72 and the first reflection mirror 74 may be moved in the direction of the arrow C shown in FIG. 3 by a carriage 83A, and the second reflection mirror 76 and the third reflection mirror 78 may be moved in the direction of the arrow C by a carriage 83B. Accordingly, when a document is placed on the upper face of the first platen glass 70A, the light source 72 emits illumination light to the document, and the light source 72, the first reflection mirror 74, the second reflection mirror 76, and the third reflection mirror 78 are moved in the direction of the arrow C. In this manner, the image recorded on the document is read.

Figure 4:
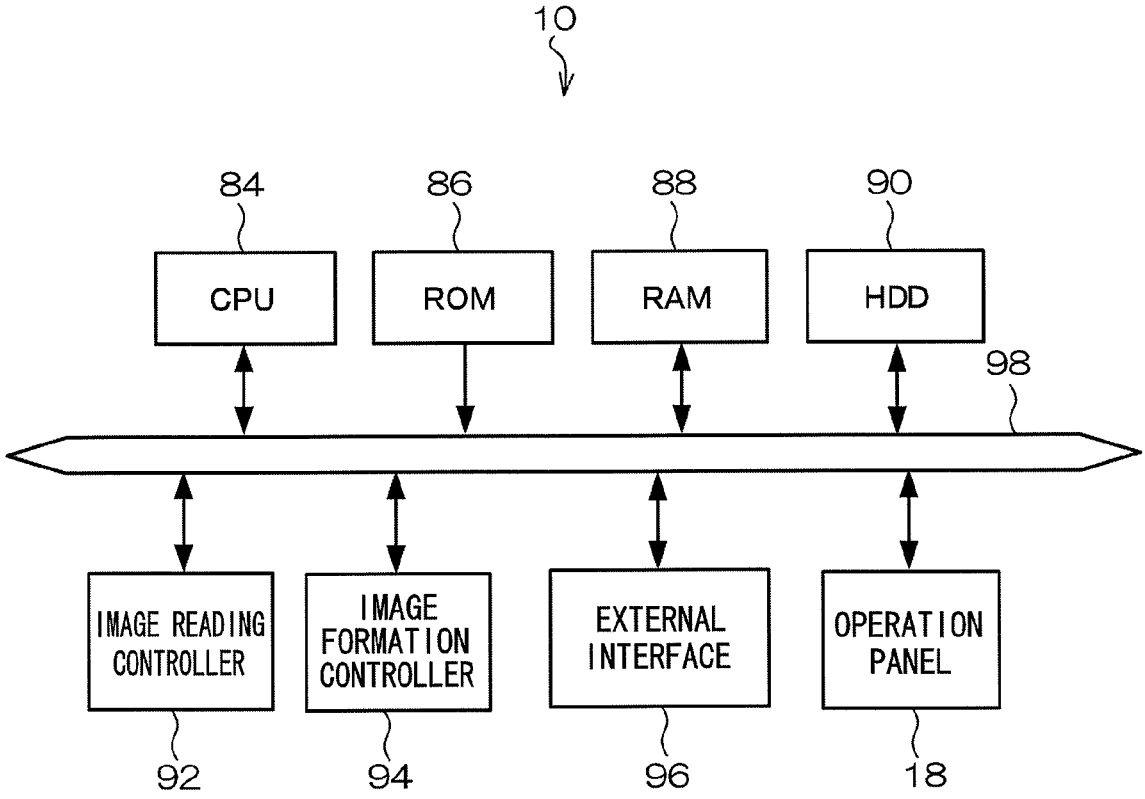
FIG. 4 is a block diagram showing the electrical components of the image processing apparatus according to the exemplary embodiment.

FIG. 4 illustrates the structure of the electrical components of the image processing apparatus 10 according to this exemplary embodiment.

The image processing apparatus 10 includes a CPU (Central Processing Unit) 84, a ROM (Read Only Memory) 86, a RAM (Random Access Memory) 88, and a HDD (Hard Disk Drive) 90. The CPU 84 controls the operation of the entire image processing apparatus 10. Various programs, various parameters, various kinds of table information, and the likes are stored into the ROM 86 in advance. The RAM 88 is used as the work area when the CPU 84 executes the various programs. The HDD 90 stores various kinds of information, such as image data for images read by the image reading device 12, and image data received through the later described external interface 96.

The image processing apparatus 10 further includes an image reading controller 92, an image formation controller 94, and an external interface 96. The image reading controller 92 is connected to the image reading device 12, and controls optical image reading operations performed by the image reading device 12. The image formation controller 94 is connected to the image forming device 14, and controls formation of images performed by the image forming device 14. The external interface 96 is connected to an external terminal device, and exchanges various kinds of information including image data with the external terminal device.

The CPU 84, the ROM 86, the RAM 88, the HDD 90, the image reading controller 92, the image formation controller 94, the external interface 96, and the operation panel 18 are electrically connected to one another via a system bus 98. Accordingly, the CPU 84 is capable of accessing the ROM 86, the RAM 88, and the HDD 90, grasping the operational state of the operation panel 18, displaying various kinds of messages on the operation panel 18, controlling the operations of the image reading controller 92 and the image formation controller 94, and exchanging various kinds of information with the terminal device via the external interface 96.

When the image formed on a document placed on the document tray 22 is read, and an operation is performed to form an image on a recording sheet based on the read image (hereinafter referred to as the "copying operation"), the CPU 84 of this exemplary embodiment transmits a begin transportation signal to the image reading controller 92 to begin transporting the document placed on the document tray 22.

When a letter-size document of 8.5 inches (215.9 mm) in width and 11 inches (279.4 mm) in length is placed on the document tray 22 in a conventional structure, the document width detection sensor 29 may wrongly determine that the letter-size document is an A4 document (210 mm in width, 297 mm in length) which has a width close to the width of the letter-size document. Consequently, side registration misalignment of the image formed on the recording sheet through the copying operation may result.

Therefore, in the image processing apparatus 10, when the width of a detected document is a predetermined size (hereinafter referred to a "designated width") that differs from any of the regular sizes, a designated width transportation prohibition mode for prohibiting the transportation of a document of a designated width may be set through the operation panel 18.

In the image processing apparatus 10 according to this exemplary embodiment, the designated width is 8.5 inches, which is a letter-size width.

Figure 5:
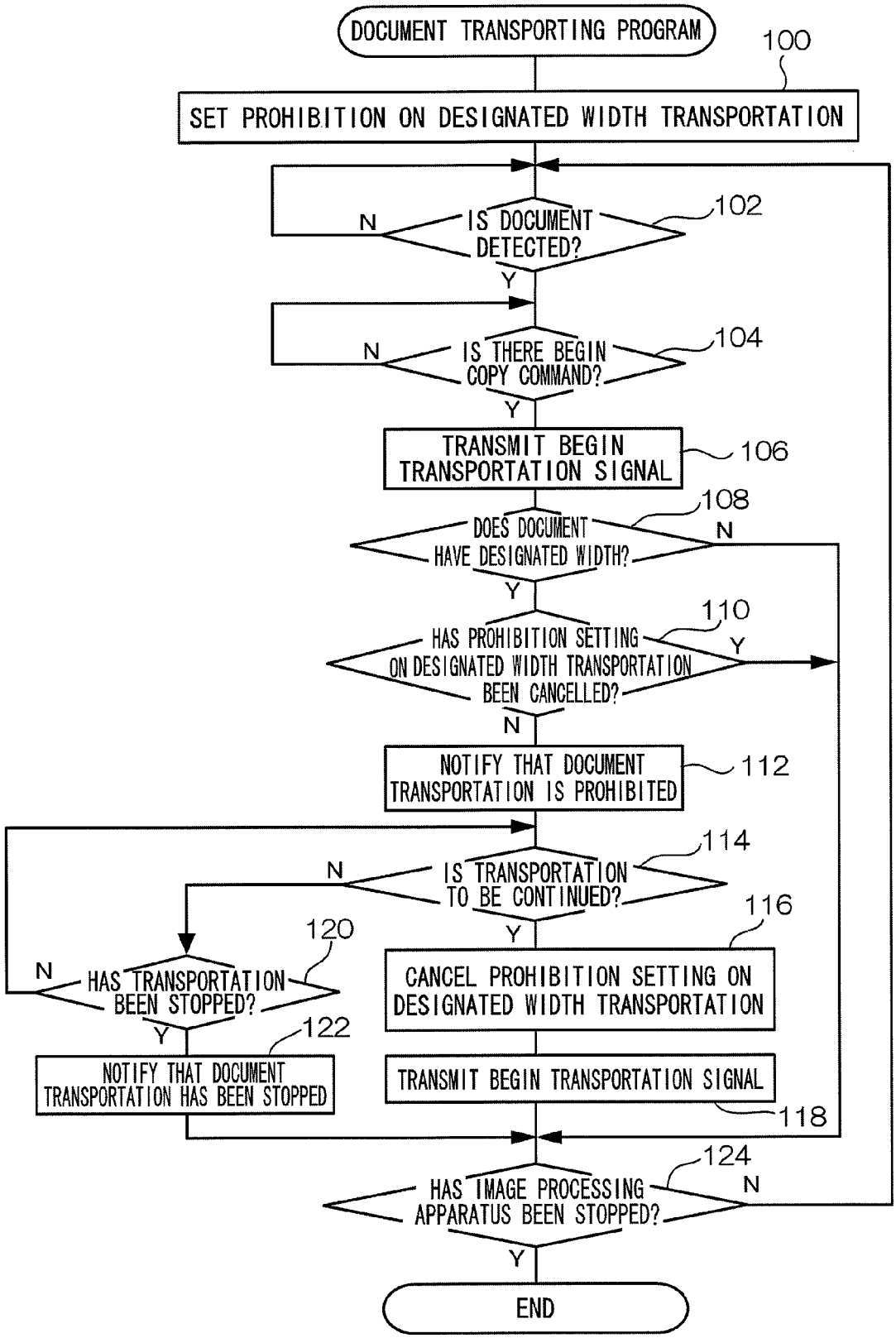
FIG. 5 is a flowchart showing an operation flow according to a document transporting program of the exemplary embodiment.

Referring now to FIG. 5, the operation of the image processing apparatus 10 of this exemplary embodiment is described. FIG. 5 is a flowchart showing an operation flow of a document transporting program that is executed by the CPU 84 when the power is supplied to the image processing apparatus 10 that is set in the designated width transportation prohibition mode. The document transporting program is stored beforehand in a predetermined location of the ROM 86 that serves as a storage medium.

First, at step 100, the image reading controller 92 is set to prohibit transportation of letter-size documents having the designated width (hereinafter referred to as the "designated width transportation prohibition setting"). Further, a designated width transportation prohibition flag that indicates that the designated width transportation prohibition setting has been set.

At step 102, the image processing apparatus 10 is in a stand-by state until the document detection sensor 28 detects that a document is placed on the document tray 22.

At step 104, the image processing apparatus 10 is in a stand-by state until a user inputs a begin copying command through the operation panel 18.

At step 106, a begin transportation command signal is transmitted to the image reading controller 92.

Upon receipt of the begin transportation command signal, the image reading controller 92 transmits the document width detected by the document width detection sensor 29 to the CPU 84.

When the designated width transportation prohibition setting has been set, after the image reading controller 92 receives the begin transportation command signal, the document transport unit 40 transports the document if the document width detected by the document width detection sensor 29 is of the A series, and prohibits document transportation if the document width detected by the document width detection sensor 29 is the designated width.

In the image processing apparatus 10 according to this exemplary embodiment, the nudger roller 46 for transporting a document placed on the document tray 22 is not activated even when the begin transportation command signal is received. In this manner, transportation of the document is prohibited. Further, other rollers such as the feed rollers 50 and the take-away rollers 52 may also be deactivated in this manner.

At step 108, it is determined whether the document width detected by the document width detection sensor 29 is the designated width. When the determination result is positive, the operation moves on to step 110. When the determination result is negative, the operation moves on to step 124.

At step 110, it is determined whether the designated width transportation prohibition setting has been cancelled. When the determination result is positive, the operation moves on to step 124. When the determination result is negative, the operation moves on to step 112. In the image processing apparatus 10 according to this exemplary embodiment, the above determination result is positive when the designated width transportation prohibition flag is set while the above determination result is negative when the designated width transportation prohibition flag is reset.

In a case where the designated width transportation prohibition setting has been cancelled, the document transport unit 40 transports the document when the image reading controller 92 receives the begin transportation command signal, even if the width of the document detected by the document width detection sensor 29 is the designated width, regardless of whether the document transport unit 40 is in the designated width transportation prohibition mode.

At step 112, the document width detection sensor 29 detects the document of the designated width, and notifies that transportation of documents having the designated width is prohibited (or stopped).

Figure 6:
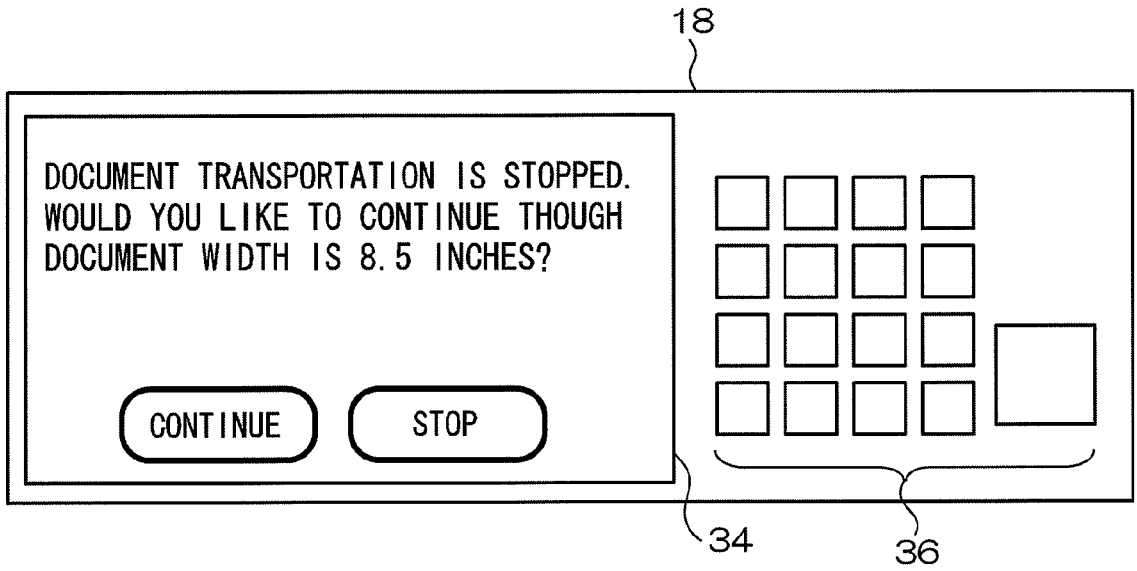
FIG. 6 illustrates a situation where the operation panel of the exemplary embodiment displays a message to the effect that transportation of documents having a certain width is prohibited.
Figure 7:
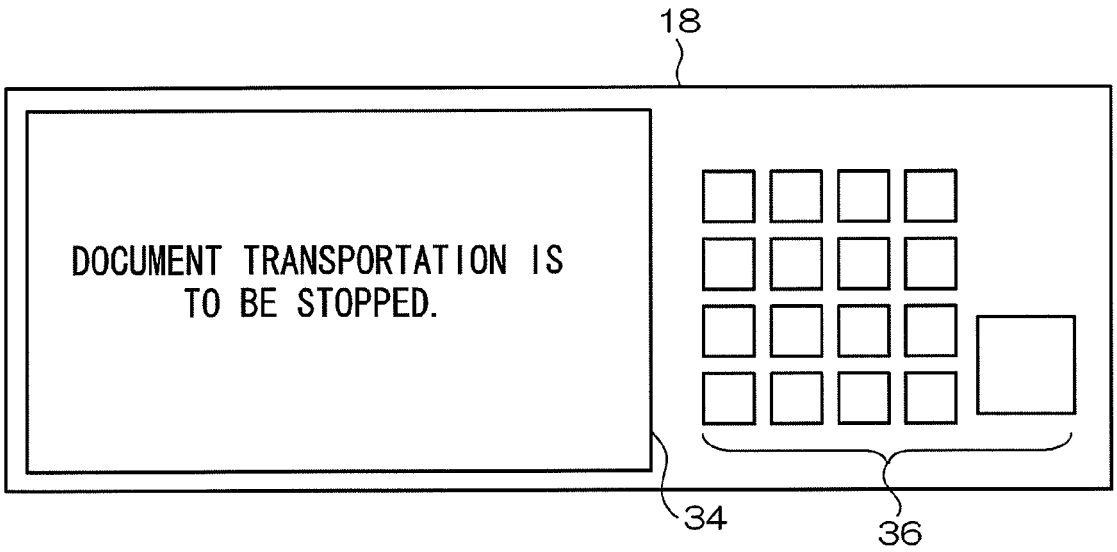
FIG. 7 illustrates a situation where the operation panel of the exemplary embodiment displays a message to the effect that document transportation has been stopped.

In the image processing apparatus 10 according to this exemplary embodiment, the touch panel display 34 gives the notification by displaying a message to the effect that transportation of the document is prohibited and the width of the document is detected as 8.5 inches, as shown in FIG. 6. However, the notification may also be given by a speaker (not shown).

At step 114, it is determined whether a user has input a command to continue the document transportation. When the determination result is positive, the operation moves on to step 116. When the determination result is negative, the operation moves on to step 120. A case in which the user inputs a command to continue the document transportation, for example, is when the user has placed a letter-size document of 8.5 inches in width on the document tray 22.

In the image processing apparatus 10 according to this exemplary embodiment, when the image of a "continue" button displayed on the touch panel display 34 shown in FIG. 6 is pressed by the user, the determination result is set positive. However, the determination result may be set positive also in a case where the user presses a switch 36 designed specifically for inputting of a continue command.

At step 116, the designated width transportation prohibition imposed on the image reading controller 92 is cancelled. Thereafter, when a document width detected by the document width detection sensor 29 is the designated width, the document transport unit 40 does not prohibit transportation of the document, but transports the document. Further, the designated width transportation prohibition flag is reset.

At step 118, the begin transportation command signal is transmitted to the image reading controller 92, and the operation moves on to step 124. Receiving the begin transportation command signal, the image reading controller 92 causes the document transport unit 40 to begin transporting the document placed on the document tray 22.

At step 120, it is determined whether the user has input an instruction to stop the document transportation. When the determination result is positive, the operation moves on to step 122. When the determination result is negative, the operation returns to step 114. For example, when the user has placed an A4 document on the document tray 22, the user stops the document transportation.

In the image processing apparatus 10 according to this exemplary embodiment, the determination result is positive when the image of a "stop" button displayed on the touch panel display 34 shown in FIG. 6 is pressed by the user. However, the determination result may be positive also in a case where the user presses a switch 36 designed for inputting a stop command.

At step 122, a notification that the document transportation has been stopped is transmitted, and the operation moves on to step 124. In the image processing apparatus 10 according to this exemplary embodiment, the notification is given by the touch panel display 34 by displaying a message to the effect that the document transportation has been stopped. However, the notification may also be given by a speaker (not shown).

Thereafter, when the user places an A4 document on the document tray 22, for example, the user moves the guide 26B while checking the notification from the document width notifying unit 30. In this manner, the document width detection sensor 29 detects that the document placed on the document tray 22 has the A4 width, and the image processing apparatus 10 restarts the copying operation.

At step 124, it is determined whether the power supply to the image processing apparatus 10 has been stopped. When the determination result is positive, the execution of this program is ended. When the determination result is negative, the operation moves on to step 102. The power supply to the image processing apparatus 10 is stopped in a case in which the image processing apparatus 10 is deactivated such as when the power switch of the image processing apparatus 10 is put into a non-operating state, when the power switch of the image processing apparatus 10 is switched off, or when the image processing apparatus 10 enters a power saving mode or the like.

Although the exemplary embodiment has been described so far, the technical scope of the invention is not limited by the description of the exemplary embodiment. Various changes and modifications may be made to the exemplary embodiment without departing from the spirit of the invention, and the changes and modifications should be included in the technical scope of the invention.

The exemplary embodiment does not limit the invention, and not all the combinations of features described in the description of the exemplary embodiment are essential to the means for solving a technical problem according to the invention. Various stages of the invention are included in the exemplary embodiment, and a number of inventions may be developed from the combinations of the components disclosed above. Even if some of the components are removed from all the components disclosed above, the combinations of the remaining components may be developed as inventions.

For example, in the exemplary embodiment, the A-series widths and B-series widths are employed as the predetermined regular sizes, and the letter-size width, which is 8.5 inches, is employed as the designated width. However, the letter-size width may be employed as a predetermined regular size, and an A4 width may be employed as the designated width, for example.

In the exemplary embodiment, the guide 26B is movable in the width direction of the document placed on the document tray 22. However, the both guides 26A and 26B may be made movable in the width direction of the document placed on the document tray 22.

In the exemplary embodiment, a notification is issued to notify the user that document transportation is prohibited. However, a notification may also be issued to notify the user that a document is being transported when the document is transported.

The structure of the image processing apparatus 10 of the exemplary embodiment (see FIGS. 1 through 4) is merely an example, and unnecessary parts may be removed from the structure or some new part may be added to the structure without departing from the spirit of the invention.

The operation flow according to the document transporting program described in the exemplary embodiment (see FIG. 5) is also merely an example, and unnecessary steps may be removed from the operation flow, or some new step may be added to the operation flow, or the processing order may be changed, without departing from the spirit of the invention.

The document transporting program according to the exemplary embodiment may not be stored beforehand into the ROM 86, but may be stored beforehand into the HDD 90, or may be provided through a computer-readable storage medium, or may be distributed through a wire or wireless communication unit, for example.

What is claimed is:

1. A transporting device comprising:

a transport unit that transports a document placed on a document tray;

a detector that detects a width of the document placed on the document tray;

a controller that controls the transport unit so as to transport the document when the width of the document detected by the detector is a predetermined fixed size, and prohibits the transport unit from transporting the document when the width of the document is a predetermined size that is different from the fixed size; and a cancellation unit that cancels the prohibition of document transportation imposed by the controller; and, wherein the predetermined size that is different from the fixed size is stored in a memory before the transporting of the document is prohibited.

2. The transporting device of claim 1, further comprising a pair of guide units that guides the document when the document placed on the document tray is transported by the transport unit, at least one of the guides being movable in a width direction of the document placed on the document tray, wherein the detector detects a position of the at least one of the guides.

3. The transporting device of claim 1, further comprising a notifying unit, wherein the controller controls the notifying unit to transmit at least one of a notification that the document is being transported, a notification that transportation of the document is prohibited, or a notification that the width of the document detected by the detector is the predetermined fixed size.

4. The transporting device of claim 1, wherein the predetermined fixed size is 210 mm or 8.5 inches.

5. The transporting device of claim 1, wherein the controller causes the transport unit to transport the document when the width of the document detected by the detector is a predetermined size different from the fixed size, after the cancellation unit cancels the prohibition of document transportation.

6. An image reading device comprising:

the transporting device of claim 1; and an acquisition unit that reads an image formed on a document being transported by the transporting device, and acquires image data for the image.

7. A method for controlling a transporting device that detects a width of a document placed on a document tray and transports the document, the method comprising:

causing the transporting device to transport the document when the width of the document is a predetermined fixed size, and to prohibit transportation of the document by the transporting device when the width of the document is a predetermined size different from the fixed size; and canceling the prohibition of the document transportation; and, wherein the predetermined size that is different from the fixed size is stored in a memory before the transporting of the document is prohibited.

8. The method of claim 7, wherein the predetermined fixed size is 210 mm or 8.5 inches.

9. The method of claim 7 further comprising:

transporting, by the transporting device, the document when the width of the document is a predetermined size different from the fixed size, after the canceling of the prohibition of document transportation.

10. A computer-readable storage medium that stores a program for controlling a transporting device that detects a width of a document placed on a document tray and transports the document, the controlling including:

causing the transporting device to transport the document when the width of the document is a predetermined fixed size, and to prohibit transportation of the document by the transporting device when the width of the document is a predetermined size different from the fixed size; and canceling the prohibition of the document transportation; and, wherein the predetermined size that is different from the fixed size is stored in a memory before the transporting of the document is prohibited.

11. The computer-readable storage medium of claim 10, wherein the predetermined fixed size is 210 mm or 8.5 inches.

12. The computer-readable storage medium of claim 10, wherein the controlling further comprises:

transporting, by the transporting device, the document when the width of the document is a predetermined size different from the fixed size, after the canceling of the prohibition of document transportation.

13. The transporting device of claim 1, wherein the detector detects the width of the document by detecting a position of the at least one of the guides.

* * * * *